United States Patent [19]

Vila

[11] 4,231,405

[45] Nov. 4, 1980

[54] PENCIL DRIVEN MECHANICAL PENCIL SHARPENER

[76] Inventor: Jose F. Vila, 5508 31st Ave., No. 3, Woodside, N.Y. 11377

[21] Appl. No.: 912,225

[22] Filed: Jun. 5, 1978

[51] Int. Cl.[2] ..... B43L 23/02

[52] U.S. Cl. ..... 144/28.4; 74/125.5; 144/28.6; 145/3.5; 145/53; 74/84 R

[58] Field of Search ..... 144/28.1, 28.11, 28.3, 144/28.4, 28.6; 145/3.5, 3.9, 53, 54; 74/84, 125.5, 127, 130, 424.8; 81/57.39

[56] References Cited

U.S. PATENT DOCUMENTS

| | | | |
|---|---|---|---|
| 240,223 | 4/1881 | Belcher | 145/53 |
| 271,481 | 1/1883 | Lewis | 74/127 |
| 332,146 | 12/1885 | Forrester | 144/28.1 |
| 452,617 | 5/1891 | Satterlee | 74/130 |
| 487,946 | 12/1892 | Edwards, Jr. et al. | 74/127 X |
| 570,617 | 11/1896 | Stough | 144/28.4 |
| 968,324 | 8/1910 | Carter | 144/28.4 |
| 1,061,773 | 5/1913 | Nahlinger | 74/127 |
| 1,182,327 | 5/1916 | Soty | 144/28.11 |
| 1,201,458 | 10/1916 | Haley | 144/28.4 |
| 1,262,363 | 4/1918 | Lopez | 144/28.4 |
| 1,290,489 | 1/1919 | Bauer | 145/53 |
| 2,307,119 | 1/1943 | Duany | 144/28.11 |
| 2,470,387 | 5/1949 | Baggett | 144/28.11 |
| 2,555,995 | 6/1951 | Pitzer, Jr. | 74/130 |

*Primary Examiner*—W. Donald Bray
*Attorney, Agent, or Firm*—Kirschstein, Kirschstein, Ottinger & Cobrin

[57] ABSTRACT

A mechanical pencil sharpener including a housing with a cutter assembly adapted to receive the end of a pencil along its longitudinal axis. The manual force associated with inserting a pencil into the cutter assembly causes the cutter assembly to slidably move along its longitudinal axis within the housing. Engaging means responsive to the axial slidable movement of the cutter assembly translates such slidable movement into simultaneous rotational movement of the cutter assembly. A spring is used to return the cutter assembly to its initial position when the pencil is withdrawn therefrom. A coupling means responsive to axial slidable movement of the cutter assembly in a forward or backward direction or both is employed to selectively actuate the engaging means.

8 Claims, 20 Drawing Figures

FIG. 1.
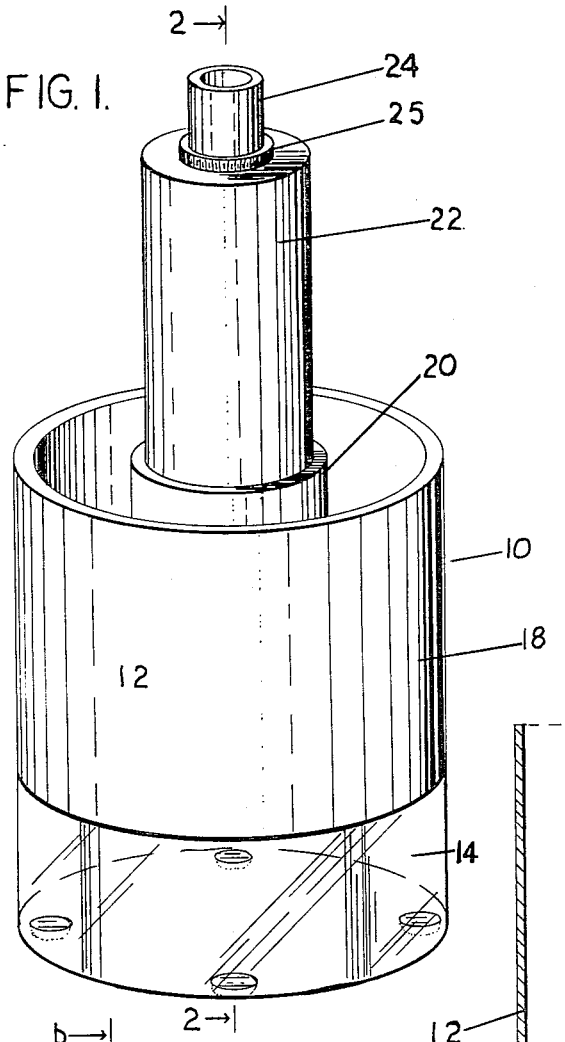
FIG. 2
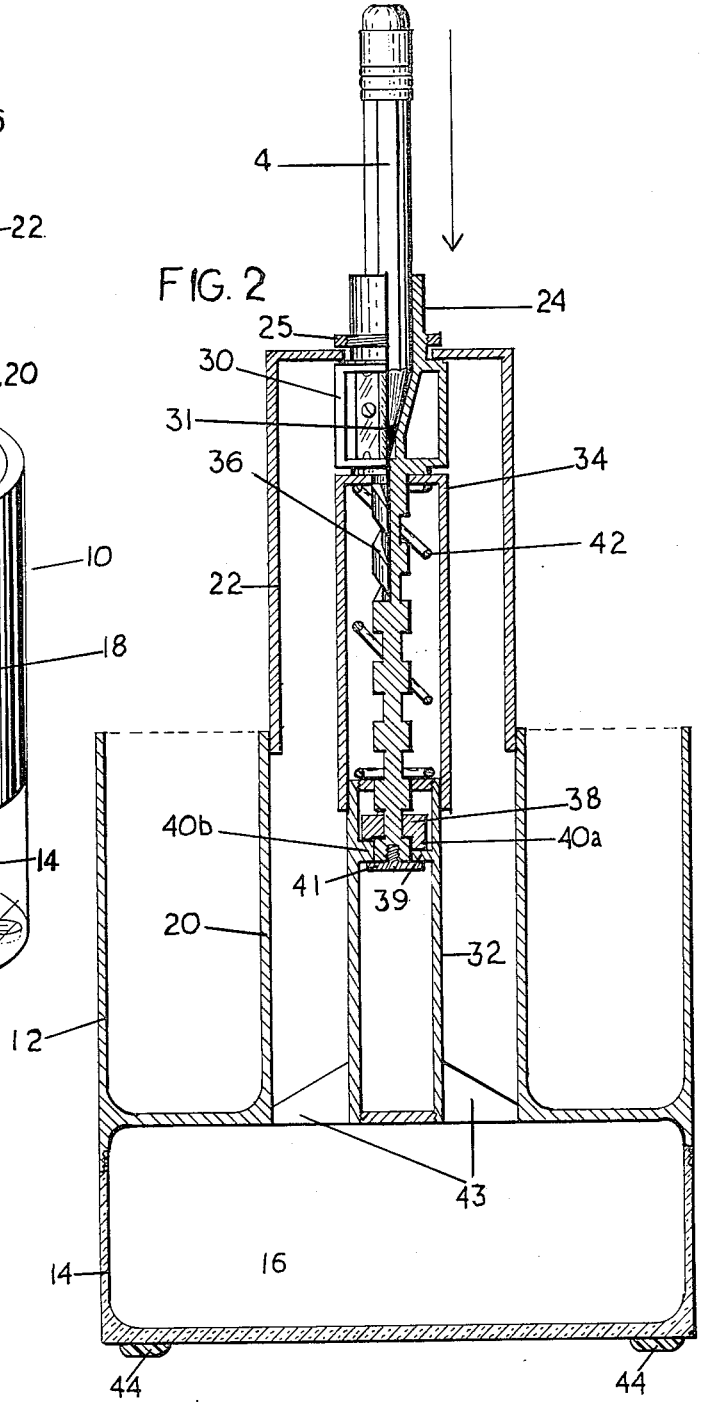
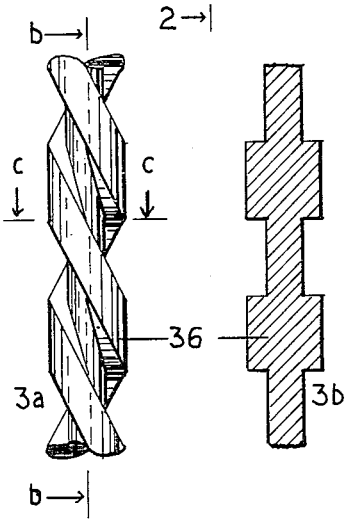
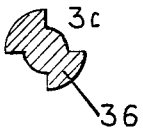
FIG. 3.
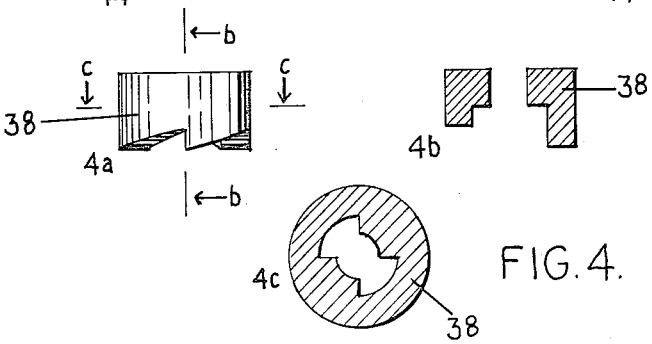
FIG. 4.

PENCIL DRIVEN MECHANICAL PENCIL SHARPENER

BACKGROUND OF THE INVENTION

1. Field of the Invention

This invention relates to a manually operated pencil sharpener and particularly to a mechanical pencil sharpener having a slidably rotatable cutter assembly which is activated by the manual force associated with the insertion of a pencil therein.

2. Description of the Prior Art

Manually operated pencil sharpeners are well known. For example, there are the simple blade types or those where a cutter assembly is rotated via gearing, a crank or handle. In order to sharpen a pencil in these types of devices, the operator must hold the pencil in one hand and crank the handle of the pencil sharpener with the other hand or the operator manually rotates the pencil (or sharpener) about its longitudinal axis within a cutter assembly. In general, these types of sharpeners must by clamped, bolted or otherwise affixed to a stable substrate (making them a permanent, non-portable fixture). Other types of manually operated pencil sharpeners having rotatable cutting assemblies are shown in U.S. Pat. Nos. 1,182,327 and 2,470,387. For example, U.S. Pat. No. 1,182,327 teaches a pencil sharpener having two symmetrical knife carrying frames with helically bent cutting blades mounted to a spirally threaded stem. A thumb-nut is threaded on the stem which, when forced down the stem by the action of fingers, forcibly rotates the stem and the cutting frames of the pencil sharpener.

Motor-driven sharpeners with separate starting switches are also well known. These motor-driven pencil sharpeners operate on live current or are battery powered. However, they require costly electrical energy and have unattractive cords which are potentially hazardous. The cordless type, such as battery-powered sharpeners, have the disadvantage of requiring frequent changes of batteries.

SUMMARY OF THE INVENTION

1. Purposes of the Invention

It is an object of this invention to provide a manually operated pencil sharpener having both the convenience of operation associated with an electric pencil sharpener and the economy of a mechanically driven pencil sharpener.

Another object of this invention is to provide a manually operated pencil sharpener which is portable, i.e., it need not be fixedly secured or anchored to the surface of a substrate in order to operate it.

Still another object of the invention is to provide a pencil sharpener which combines simplicity of construction with efficiency in operation.

It is also an object of this invention to provide a pencil sharpener which, because of its simple and elegant design, can be incorporated into a variety of housings therefor.

An object of this invention is to provide a pencil sharpener which utilizes the natural insertion motion of a pencil into a cutting assembly to cause rotation of the cutting assembly.

A further object of this invention is to provide a pencil sharpener which sharpens a pencil upon insertion of the pencil within the cutting assembly without further manipulation or cranking of a handle.

A still further object of this invention is to provide a pencil sharpener which has one or more clutches or coupling assemblies in combination with biasing means such as a spring for sharpening a pencil only when the pencil is inserted into or withdrawn from the cutter assembly.

An object of this invention is to provide a pencil sharpener wherein sharpening of a pencil is a one-hand operation.

Another object of this invention is to provide a pencil sharpener having a cutter assembly wherein a plurality of insertions and withdrawals of a pencil into and out of the cutting assembly repositions the pencil inside the cutting assembly a sufficient number of times to effect a substantially equal distribution of cutting forces on the pointed end of the pencil.

Another object of this invention is to provide a pencil sharpener whereby a pencil is sharpened while the pencil remains inside the cutter assembly during the insertion and withdrawal strokes of the pencil into and out of the cutter assembly.

A still further object of this invention is to provide for a cleaner or finished pencil point by removing the remaining loose pencil shavings with light strokes of the cutter assembly.

These and other objects and advantages of the present invention will become evident from the description which follows.

2. Brief Description of the Invention

This invention relates to a mechanical pencil sharpener which is actuated by the manual force associated with the insertion of a pencil thereinto. Fundamentally, a pencil is inserted into a cutter assembly having a longitudinal axis and which is rotatably and slidably mounted within the pencil sharpener. As the pencil is pushed into the cutter assembly along its longitudinal axis, the cutter assembly axially moves in the direction of insertion. A conversion means is provided for converting the axial movement of the cutter assembly into rotational movement thereof. A coupling means is provided for selectively actuating the converting means when the pencil is inserted into the cutter assembly or withdrawn therefrom, or both. A spring means is employed to automatically return the cutter assembly to its initial position when the pencil is withdrawn therefrom. The rotational movement of the cutter assembly relative to the rotational stationary pencil (held by fingers) operates to sharpen the forward end of the pencil inserted into the cutter assembly.

A pencil may be sharpened in the pencil sharpener of this invention by employing one continuous axial insertion stroke with sufficient penetration into the pencil sharpener to sharpen the pencil, or the axial strokes of a pencil in a reciprocating manner (in and out of the sharpener) may be repeated until the pencil is sharpened. Moreover, actual sharpening of the pencil may occur selectively according to the particular coupling assembly employed as discussed more fully subsequently herein. Actual sharpening may thus occur only in one direction of axial movement of a pencil within the sharpener or in both directions (in and out) of such axial movement. The repetitious or reciprocating motion of a pencil being inserted and withdrawn from the cutter assembly provides an opportunity to inspect the degree to which the pencil has been sharpened. Moreover, the slight repositioning of the pencil in the cutter assembly of the pencil sharpener allows for a more perfectly conical point and a more compact pencil sharpener. Various mechanical converting means and coupling assemblies are disclosed in combination with a spring, cutter assembly, rod and other elements according to the present invention.

In its broadest aspect, this invention relates to a mechanical pencil sharpener actuated by insertion of a pencil thereinto which sharpener comprises: a frame, a cutter assembly, a rod, a conversion means, a spring and a coupling means.

The frame or housing of the pencil sharpener of applicant's invention can assume any number of shapes, such as rectangular, cylindrical, octagonal, prismatic, or even familiar decorative items such as vases, statutes or the like with very little modification. The frame or housing also includes a hollow compartment or chamber for receiving pencil shavings. Generally, the housing has a base which is substantially linear which allows it to be placed upon a table, desk or the like. Also, the surface of the base should hold the housing stationary when used. Consequently, it may be of a material which adheres by friction forces or have means for adhering to a surface on which it is placed, e.g., small rubber pads mounted to the base.

The cutter assembly has a longitudinal axis and is rotatably and slidably mounted within the frame. A pencil inserted into the cutter assembly is forced against a portion thereof to cause slidable movement of the cutter assembly in the direction of movement of the pencil, from an initial position to a displaced position.

A rod which may contain a helical groove on its external surface or which may be hollow and contain a helical groove on its internal surface or which contains no grooves therein rotates the cutter assembly to sharpen the pencil. The rod has an elongated longitudinal axis, depends from the cutter assembly and is coaxially aligned therewith. Also, the cutter assembly and rod are kinematically unitary, i.e., the rod is fixed to the cutter assembly for slidable movement and rotation in unison therewith.

A motion alignment means such as inner and outer telescoping sleeves encasing the cutter assembly and rod is preferably rotatably attached to the cutter assembly and rod for aligning their slidable movement so that such slidable movement is substantially rectilinear. Although the cutter assembly and rod would operate satisfactorily without a motion alignment means, the motion alignment means provides for a more efficient and precise mechanical movement. Another function of the telescopic sleeves 32 and 34 is to act as a dust cover to protect the mechanical parts of the motion converting means and spring. Protective sleeve 34 also provides for a rotatably stationary reference base for those cutter assemblies that require it, i.e., planetary geared cutter assemblies where the geared cutter cylinders rotate and revolve within a rotatably stationary outer gear. This can be accomplished on sleeves 32 and 34 by a longitudinal slidably grooved configuration that would allow the sleeves 32 and 34 to move longitudinally but prevent them from rotating relative to each other. In such an arrangement, sleeve 32 would always be rotatably and slidably stationary.

A conversion means, for example, a cylindrical, helical-groove, engaging sleeve (when a helical groove containing rod is used) rotatably mounted within the frame and meshing with the helical groove of the rod, translates the sliding rectilinear movement of the rod and cutter assembly into simultaneous rotational movement thereof. When a helical-groove containing rod is employed, the engaging sleeve is axially coincident with the rod and concentrically disposed external thereto (when the helical groove is external of the rod) or internal thereto (when the helical groove is internal of the rod).

A spring is fixedly mounted within the frame, one end to the cutter assembly and the other end to the conversion means. The spring is so arranged that sliding rectilinear movement of the cutter assembly pushes against the spring to compress it when a pencil is inserted in the cutter assembly. Moreover, when a pencil is withdrawn, or when the inserting force is released, the spring returns to its initial position which, in turn, returns the cutter assembly to its initial position. In the embodiments of applicant's invention wherein cleaning or finishing of the pencil point occurs during the withdrawal of the pencil from the cutter assembly, it is the uncoiling axial force of the spring which imparts the rotational movement to the cutter assembly via the conversion means.

A coupling means comprised of two halves is employed, a first half being slidable and rotatable with the rod and the second half being slidable and rotationally stationary. Each of the halves have claws which can be engaged or disengaged. When the two coupling halves are connected or engaged, the coupling halves become kinematically unitary. When the two coupling halves are disconnected or disengaged, the coupling halves are kinematically separate. The claws permit locking of the two coupling halves in one sense of rotational movement only. In the opposite sense of rotational movement, there is slipping but not locking of the two coupling halves. One half of the coupling means is mounted for slidable and rotatable movement with the rod and the other half is mounted for rotational movement only or no movement at all within the frame, i.e., in one embodiment, one coupling half is rotatably and slidable stationary. The two halves of the coupling means becomes connected as the spring is compressed and disconnect when the spring returns to its initial position.

This invention accordingly consists of the features of construction, combination of elements, and arrangement of parts which will be exemplified in the preferred embodiments of the pencil sharpener hereinafter described and of which the scope of application will be indicated in the appended claims.

BRIEF DESCRIPTION OF THE DRAWINGS

In the accompanying drawings in which are shown several of the various possible embodiments of the invention:

FIG. 1 is a perspective view of a pencil sharpener in accordance with the present invention.

FIG. 2 is a sectional elevation view of the pencil sharpener of FIG. 1 along lines 2—2 with a pencil inserted therein.

FIG. 3*a* is a perspective view of the helically grooved rod designated by the numeral 36 in FIG. 2.

FIG. 3*b* is a sectional elevation view of the helically grooved rod 36 of FIG. 3*a* taken along lines b—b.

FIG. 3*c* is a plan view of the helically grooved rod 36 of FIGS. 3*a* and 3*b* taken along lines c—c.

FIG. 4*a* is a perspective view of the engaging member designated by the numeral 38 in FIG. 2.

FIG. 4*b* is a sectional elevation view of the engaging member 38 of FIG. 4*a* taken along lines b—b.

FIG. 4*c* is a plan view of the engaging member 38 of FIGS. 4*a* and 4*b* taken along lines C—C.

DETAILED DESCRIPTION OF THE PREFERRED EMBODIMENTS

Figure 5:
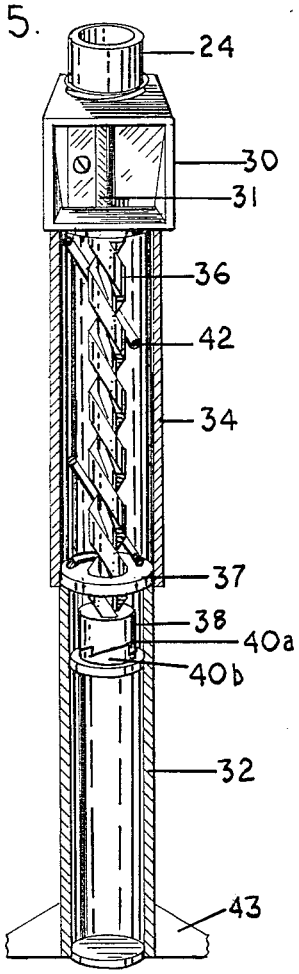
FIG. 5 is an enlarged perspective view partially in sectional elevation of the internals of the pencil sharpener of FIGS. 1 and 2.

Referring now to FIGS. 1, 2 and 5, a pencil sharpener 10 is shown comprised of hollow cylindrical housing 12. A lower portion of housing 12 designated by the numeral 14 defines a hollow, preferably transparent chamber 16 for receiving pencil shavings. An upper portion of housing 12 designated by the numeral 18 has an inner, hollow, cylindrical sleeve 20 integrally mounted thereto, sleeve 20 and housing 12 being coaxially aligned and axially coincident. The space between sleeve 20 and housing portion 18 is for holding pencils that are to be sharpened. A hollow, cylindrical sleeve 22 is coaxially aligned with sleeve 20. The outer surface of sleeve 22 at its lower end is shown slidably mounted to the inner surface of sleeve 20 at its upper end (when both sleeves are in a vertical orientation). A hollow, cylindrical pencil alignment sleeve 24 is coaxially mounted within sleeve 22 and fixed in position via annular ring 25 mounted by means of screw threads or the like around sleeve 24 at the top of sleeve 22. Ring 25 holds sleeve 22 in position in the assembly and keeps sleeve 24 freely rotatable within sleeve 22.

The outer pair of telescoping sleeves 20 and 22 define the core of the pencil sharpener. Situated within the core are cutter assembly 30, an inner pair of telescoping sleeves, inner and outer protective sleeves 32 and 34, respectively, a helically grooved rod 36, a helical groove engaging member 38, coupling members 40*a* and 40*b* and a spring 42.

Cutter assembly 30 extends from pencil alignment sleeve 24. Outer protective sleeve 34 is rotatably mounted to and depends from cutter assembly 30. Protective sleeve 34 is also coaxially aligned with cutter assembly 30. Also depending from cutter assembly 30 is the helically grooved rod 36 which is situated within outer protective sleeve 34 and extends into inner protective sleeve 32. The rod 36 and cutter assembly 30 are both mounted so as to be kinematically unitary within outer protective sleeve 34. The rod 36 and the inner and outer protective sleeves 32 and 34 are all coaxially aligned. Inner and outer protective sleeves 32 and 34 are slidable telescopically with respect to each other. The helically grooved rod 36 has threaded thereon helical groove engaging member 38, the lower portion of which is integrally formed with a claw coupling member 40*a* comprising the upper half of coupling assembly. The claw coupling member 40*a* is slidably and rotatably held stationary within sleeve 32 by engagement with claw coupling member 40*b*, which is fixedly mounted within inner protective sleeve 32 to the inner walls thereof.

Spring 42 is shown fixed in position and concentrically wound about rod 36 (with sufficient clearance between them) within outer protective sleeve 34. One end of spring 42 is fixedly connected to the inner top of sleeve 34 and the other end of spring 42 is fixedly connected to the top of sleeve 32 (which holds sleeve 32 in position within the assembly).

At the lower end of helically grooved rod 36 is fixedly attached a screw 41 or the like with a head larger than the opening where the helically grooved rod 36 passes through coupling member 40*a* and ring 39 so as to prevent the assembly from being dismantled due to the spring's expansive force.

To the base of the inner protective sleeve 32 is fixedly attached support struts 43 which are also fixedly attached to the lower inner portion of outer sleeve 20. These support struts 43 or support legs should have enough clearance from telescopic sleeve 22 so as not to obstruct the movement of telescopic sleeve 22 and prevent the full movement of helically grooved rod 36 through the engaging member 38.

At the base of the cylindrical housing 12 (14) there are one or more gripping pads 44 such as rubber pads to hold the pencil sharpener 10 stationary by friction forces when placed on top of a surface.

When a pencil 4 is inserted into the sharpener 10 of FIGS. 1, 2 and 5, it is aligned within the cutter assembly 30 via alignment sleeve 24. The downward insertion force of the pencil 4 forces the cutter assembly 30 and rod 36 to slidably move in a substantially vertically downward direction. As the rod 36 moves in such direction, the coupling members 40*a* and 40*b* lockably connect and arrest rotational and slidable movement of engaging member 38 thereby forcing the rod 36 to rotate via action of engaging member 38 in a counter-clockwise rotation along its helical groove. This, in turn, causes the cutter assembly 30 to simultaneously rotate in a counter-clockwise rotation. As the cutter assembly 30 rotates in a counter-clockwise rotation, a blade means 31 situated therein spins about one end of the longitudinal sheath of pencil 4 sharpening such end into a conically shaped point.

The pencil shavings fall out of cutter assembly 30 down between the inner wall of sleeve 22 and outer wall of protective alignment sleeve 34 and pass between the inner wall of sleeve 20 and outer wall of alignment sleeve 32 and pass the support struts 43 and into the hollow transparent chamber 16 of lower portion of housing 12.

As can be easily visualized from FIGS. 3*a*, 3*b*, 3*c*, 4*a*, 4*b* and 4*c*, helically grooved rod 36 and engaging member 38 can be meshed together by means of complementary fitted sections of the rod 36 and engaging member 38 which typically thread together. The cross-section of rod 36 (see FIG. 3*c*) meshes within a mating cross-sectional opening in engaging member 38. A set of two complementary grooves are used for torsional balance.

Referring to FIGS. 4*a* and 4*b*, it can be seen that one end of engaging member 38 (the lower end in this embodiment) may be formed so that it terminates in a claw-type coupling member 40*a*.

Figure 6:
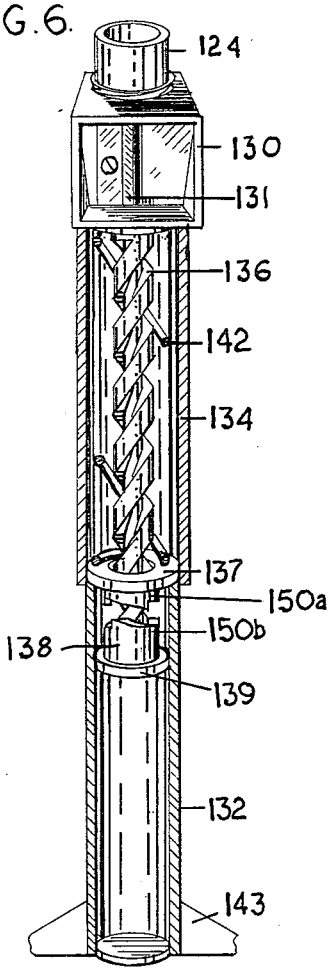
FIG. 6 is a perspective view partially in sectional elevation of the pencil sharpener in another embodiment of this invention.

During rotation and slidable movement of outer protective sleeve 34 downward relative to stationary inner protective sleeve 32, spring 42 is compressed. As the pencil 4 is withdrawn from the cutter assembly 30, spring 42 is allowed to expand and substantially return to its initial position. Expansion of the spring, in turn, causes the cutter assembly 30 to return to it initial position. While the cutter assembly 30 is being returned to its original position, coupling member 40*a* rides upward on the upward moving rod 36. This is due to the upward vertical force transmitted to the helically grooved coupling member 40*a* by the slope of the helical grooves of helically grooved rod 36. Consequently, coupling member 40*a* disconnects from slidably stationary coupling member 40*b*. Rotation of cutter assembly 30 and rod 36 (and sharpening of the pencil 4) are thus arrested during reverse movement of the cutter assembly 30 and rod 36 to their initial positions in this embodiment Referring now to FIG. 6, there are shown upper and lower claw-type coupling members 150*a* and 150*b*, respectively. When coupling member 150*a* and coupling member 150*b* are connected, they form a kinematically unitary coupling assembly. Upper coupling member 150*a* is fixedly mounted to ring 137. Both coupling member 150*a* and ring 137 have cross-sectional central openings therein sufficiently large to permit passage of rod 136 therethrough. Ring 137 is fixedly mounted to inner protective sleeve 132 with its plane transverse to the longitudinal axis of sleeve 132. The helical grooves of the helically grooved rod 136 in this embodiment are in an opposite direction to that of the helically grooved rod 36 in FIG. 5 and the engaging member 138 of this embodiment (FIG. 6) threads the oppositely directed helical grooves.

Lower coupling member 150*b* is formed at the upper end of engaging member 138 which has a cross-sectional opening that meshes with rod 136 as described previously herein for rod 36 and coupling member 38. Coupling member 150*b* and engaging member 138 form a unitary piece which is slidably and rotatably mounted within inner protective sleeve 132 that is telescopible into sleeve 134. Ordinarily, the pitch of the helical groove on the rod 136 will allow for facile meshing and engaging member 150*b* will, by force of gravity, spiral down until stopped and supportably held by ring 139. Ring 139 also has a cross-sectional opening therein sufficiently large to permit passage of rod 136 therethrough and is fixedly mounted to inner protective sleeve 132 with its plane transverse to the longitudinal axis of sleeve 132.

When the pencil 4 is inserted into pencil alignment sleeve 124 and cutter assembly 130, rod 136 and cutter assembly 130 do not rotate since the one-way coupling assembly slips but does not connect in the direction of pencil insertion. Since engaging member 138 is not held rotatably stationary with respect to rod 136, rod 136 is not forced to rotate.

Sleeve 132 is secured to support struts 143.

When the pencil is withdrawn from the cutter assembly 130 or the downward force released, the expansion of spring 142 forces the rod 136 and cutter assembly 130 backward to their respective initial positions. Engaging member 138 rides along with rod 136 until coupling member 150*b* connects with slidably and rotatably stationary coupling member 150*a* so that the two become kinetically unitary. The rectilinear slidable movement of rod 136 returning to its initial position relative to the rotatably stationary engaging member 138 forces the rod 136 and cutter assembly 130 to rotate. The rotation of cutter assembly 130 does not sharpen the pencil effectively because the expansive force of spring 142 is not sufficient to do this. However, it does cause the cutter blade 131 to lightly strike the pencil point and remove any remaining loose pencil shavings, thereby providing for a cleaner or finished pencil point.

Figure 7:
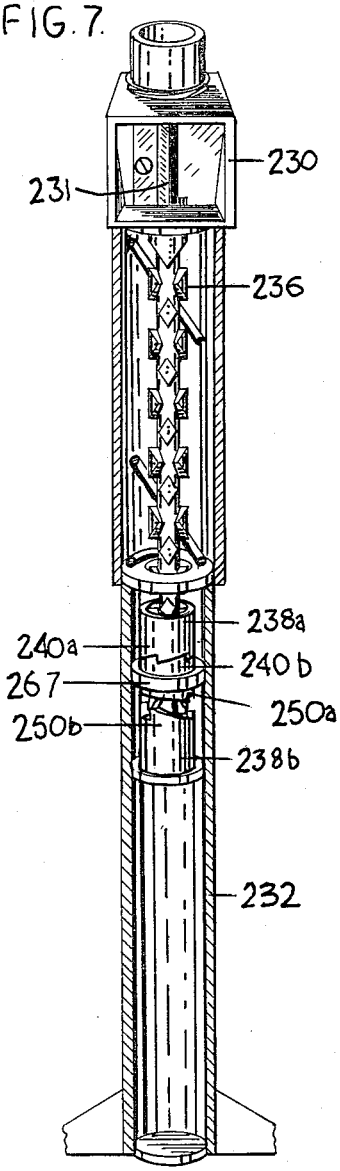
FIG. 7 is an enlarged view partially in sectional elevation of a portion of a double criss-crossing helically grooved rod 236 and double coupling members of the pencil sharpener in still another embodiment.

Referring to FIG. 7, there is shown still another embodiment of applicant's invention which is similar in construction and operation to the embodiments shown in FIGS. 1–5 and 6 except that two separate one-way coupling assemblies are employed and a combination of function is the result. A first coupling assembly comprised of coupling members 240*a* and 240*b* lockably connects when a pencil is inserted into the cutter assembly 230. These coupling members 240*a* and 240*b* are the same as the coupling members 40*a* and 40*b* previously described herein. As the pencil is inserted, engaging member 238*a* and claw-like coupling member 240*a* are forced down onto lower coupling member 240*b* which is fixedly mounted within inner protective sleeve 232 on the plane of ring 267, which plane is transverse to the longitudinal axis of the inner protective sleeve 232. The outer periphery of ring 267 is fixedly mounted to the inner wall of sleeve 232. Once the coupling assembly is connected, rotation of the rod 236 and cutter assembly 230 occur in a kinetically unitary counter-clockwise rotation as previously described herein. In a like manner, coupling members 250*a* and 250*b* form the coupling assembly which lockably connects when the pencil is withdrawn from the pencil sharpener. The latter coupling assembly operates as described with respect to the coupling assembly shown for FIG. 6.

When one coupling assembly of the double coupling assembly shown in FIG. 7 is engaged, the other one is always disengaged and vice versa. Also, when a double coupling assembly is employed, the rod 236 has two criss-crossed symmetrically disposed helically shaped grooves thereon, one set of helically parallel grooves for each of the engaging members 238*a* and 238*b*. Engaging member 238*a* rides in one set of the two helical grooves and engaging member 238*b* rides in the other and the threads of each engaging member are sufficiently long so that they remain in only one helical groove and never cross into the other helical groove.

Figure 8:
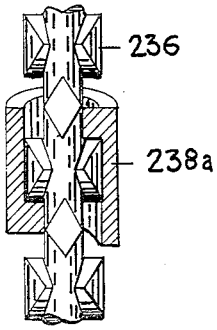
FIG. 8 is an enlarged view in perspective of the upper engaging member of FIG. 7 threaded onto a portion of the double criss-crossing helically grooved rod 236.
Figure 9:
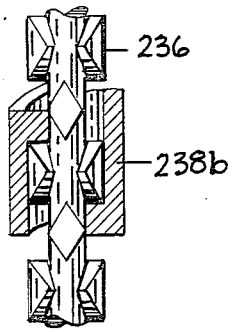
FIG. 9 is an enlarged view in sectional elevation of the lower engaging member in perspective threaded onto a portion of the double criss-crossing helically grooved rod 236 of FIG. 7.

Referring to FIG. 8, there is shown engaging member 238*a* which when fixed in position within the inner protective sleeve 232 by locking connection of coupling members 240*a* and 240*b* causes the rod 236 to rotate counter-clockwise slidably moving in a substantially vertically downwards direction; engaging member 238*a* remains meshed with one set of the two helical grooves of rod 236. Similarly, referring to FIG. 9, there is shown a second engaging member 238*b* meshed with the other set of the two helical grooves of rod 236. When fixed in position relative to the slidably moving rod 236 via the locking connection of the second set of coupling members 250*a* and 250*b*, engaging member 238*b* causes rod 236 to rotate counter-clockwise while slidably moving in a substantially vertically upwards direction; engaging member 238*b* also remains meshed with the other of the helical grooves of rod 236.

Figure 10:
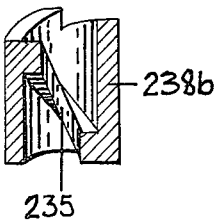
FIG. 10 is a perspective view partially in sectional elevation of the lower engaging member 238*b*.

FIG. 10 illustrates the elongated transverse helical "teeth" 235 of one of the engaging members 238*b*. The elongated "teeth" ensure that engaging member 238*b* remains meshed with the one of the helical grooves in rod 236 with which it is already meshed.

Figure 11A:
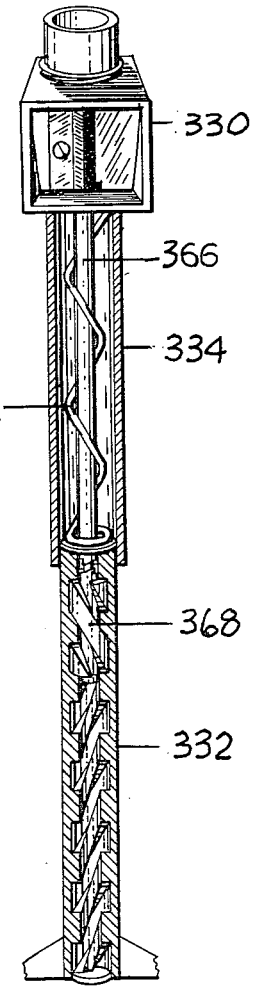
FIG. 11*a* is a perspective view partially in sectional elevation of the pencil sharpener in a further embodiment of this invention with sleeve 332 internally grooved helically.
Figure 11B:
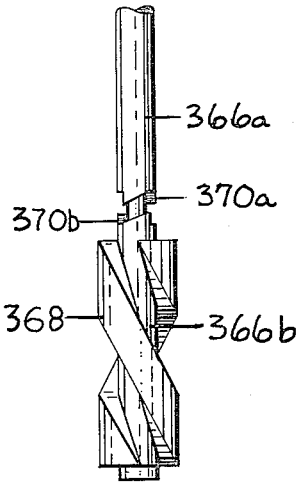
FIG. 11*b* is an enlarged perspective view of the rod and coupling members in FIG. 11*a*.
Figure 11C:
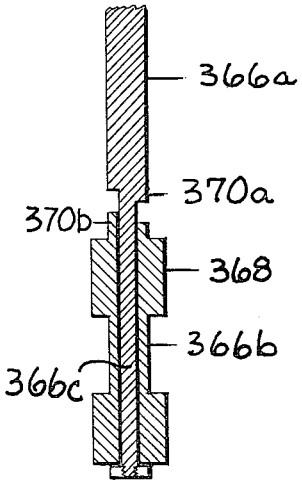
FIG. 11*c* is an enlarged sectional elevation view of the rod and coupling members of FIGS. 11*a* and 11*b*.

Referring now to FIGS. 11*a*, 11*b* and 11*c*, still another embodiment of the present invention is illustrated wherein rod 366 (comprised of rod portions 366*a* and 366*b*) is not helically grooved. Instead, rod element 366*b* has an engaging means 368 having an outer helical groove. Inner protective alignment sleeve 332 has a helical groove on its inner channel which meshes with engaging means 368. Engaging means 368 is concentrically mounted and axially coincident external to rod 366*b*. Claw-type clutch halves 370*a* and 370*b* are employed to transmit rotational movement of rod element 366*a* to rod element 366*b*. When clutch members 370*a* and 370*b* are connected, rod 366 is kinetically unitary. When clutch members 370*a* and 370*b* are disconnected, a reduced diameter segment 366*c* (guide pin) of rod element 366*a* is rotatably stationary but axially slidable within outer protective sleeve 334 and rod element 366*b* is rotatable within inner protective sleeve 332. When a pencil is inserted into cutter assembly 330, the cutter assembly 330 and rod 366*a* do not rotate immediately within the outer protective sleeve 334 but slidably move vertically downward until coupling members 370*a* and 370*b* are connected with one another. When coupling members 370*a* and 370*b* are rotatably unitary, the rotational movement of rod element 366*b* is transmitted to rod element 366*a* via clutch members 370*a* and 370*b*.

Spring 342 operates as discussed previously herein to disconnect clutch members 370*a* and 370*b* when a pencil is withdrawn from cutter assembly 330 or when a downward force is released. The same two criss-crossing grooves can be incorporated in alignment sleeve 332 of this embodiment with a correspondently threaded engaging means 368.

Figure 12A:
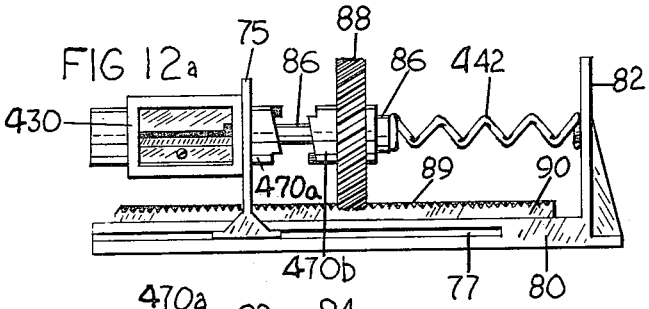
FIGS. 12*a*, 12*b* and 12*c* are perspective views of the internals of three alternate embodiments of a pencil sharpener according to the present invention.
Figure 12B:
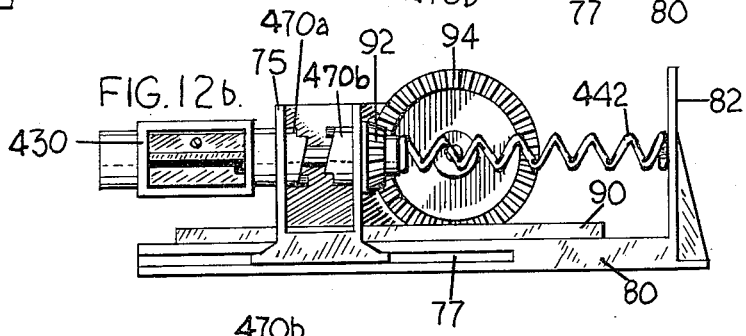
Figure 12C:
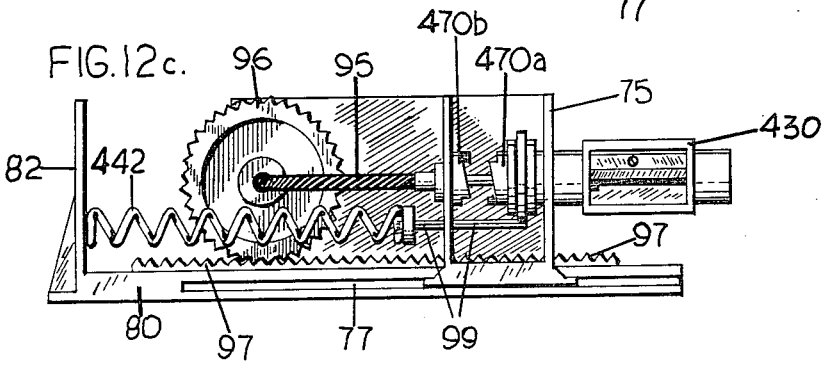

In FIGS. 12*a*, 12*b* and 12*c*, cutter assembly 430 is fixedly held by a slidable upright carriage 75. The carriage 75 is slidably mounted within a channel 77 along the base of horizontal support member (frame) 80 having an upright arm 82. Guide pin 86 is coaxially aligned with cutter assembly 430 and fixedly mounted thereto. Clutch members 270*a* and 470*b* are also coaxially aligned with guide pin 86 and concentrically disposed external thereto. Spring 442 is fixedly mounted between one end of guide pin 86 and the upright arm member 82.

Referring to FIG. 12*a*, there is shown a circularly shaped gear 88 having helical grooves about its perimeter which are meshed with corresponding diagonal grooves 89 on the upper surface of horizontal track means 90 mounted transverse to gear 88 on the support member 80. As a pencil is inserted into cutter assembly 430, the carriage 75 slides along channel 77 within the support member 80 in the direction of insertion and coupling means 470*a* engages coupling means 470*b*. The teeth of the circular gear 88 mesh with the diagonal grooves 89 to turn the gear 88 which is concentrically mounted and externally disposed on clutch member 470*b*. When rotating clutch member 70*b* rotates clutch member 470*a* which is fixedly mounted to cutter assembly 430, cutter assembly 430 rotates. When the pencil is withdrawn, spring 442 causes rotatable clutch member 470*a* to return to its initial position but it is disengaged from rotating clutch member 470*b* so cutter assembly 430 does not rotate.

Referring to FIG. 12*b*, there is shown an embodiment similar to that of FIG. 12*a*, except that a circular bevel gear 94 drives a second smaller bevel gear 92 threaded therewith. Bevel gear 94 is rotatably mounted to carriage 75. Bevel gear 92 is fixedly mounted to coupling member 470*b* and is rotatably mounted to carriage 75 holding coupling members 470*a* and 470*b*. Thus, rotation of the bevel gear 92 causes rotation of the coupling member 470*b*. The sliding part of this embodiment is the cutter assembly 430 itself. When a pencil is inserted into the cutter assembly 430, the cutter assembly 430 moves in the direction of insertion along with the guiding pin 86 affixed thereto and coaxially aligned therewith. When the two clutch members 470*a* and 470*b* are engaged, the turning of the bigger bevel gear 94 drives the smaller bevel gear 92 which, in turn, causes the cutter assembly 430 to rotate. Friction gears can be used in this embodiment whereas tooth gears must be used in the FIG. 12*a* embodiment. The bigger bevel gear 94 is caused to rotate by the same principles described with respect to the circular gear of FIG. 12*a*. When the pencil is withdrawn, spring 442 pushes the carriage 75 back to its initial position via the guiding pin 86 as the clutch members 470*a* and 470*b* disengage.

Referring now to FIG. 12*c*, there is shown an embodiment similar to that shown in FIG. 12*b*, except that a cable 95 is attached to a circular gear 96, a rack and pinion type gear. The rack 97 is mounted on the track means 90. The clutch members 470*a* and 470*b* operate as described previously with respect to FIG. 12*b*, except that coupling member 470*a* is rotatably nonslidably connected to guiding arm 99 and spring 442 is mounted between upright arm 82 and guiding arm 99 which extends slidably through carriage 75. When the coupling members 470*a* and 470*b* are forced to engage, as the pencil is inserted into the cutter assembly, arm 99 compresses spring 442 and carriage 75 is moved in the direction of pencil insertion, and the teeth of the pinion gear 96 engage the grooves 97 within the rack 90 rotating the pinion gear 96 and cable 95 attached thereto. The cable 95, in turn, causes the rotatable clutch member 470*b* to rotate and simultaneously rotate coupling member 470*a*. The rotation of the cable 95 is transformed into corresponding rotation of the cutter assembly 430 which sharpens the pencil. When the pencil is withdrawn, spring 442 causes the carriage 75 to return to its initial position wherein the clutch members 470*a* (FIGS. 12*a*, 12*b*, 12*c*) and 470*b* are disengaged. In the three embodiments shown in FIGS. 12*a*, 12*b* and 12*c*, the support members must be fixed to a stable substrate in order to operate.

The spring 442 returns all of the gears to their initial position when the pencil is withdrawn.

When constructing the various embodiments of the present invention, suitable materials should be employed keeping in mind their strength and low coefficient of friction. Preferably plastics such as nylons and acetals can be used for mechanical moving parts, and polystyrene, acrylonitrile-butadrene-styrene and acrylics can be used for the housing for economical reasons; they are relatively inexpensive materials. Metals such as aluminum and steel can also be used. The helical slopes of the helical grooves should be at an angle for efficient use of the axial forces associated with the pencil sharpener of this invention. Steeper slopes will increase the axial distance that has to be traveled for a desired rotation. This will reduce the force required to operate the pencil sharpener but increase the number of axial movements required to sharpen a pencil. Slopes which are not steep enough will require greater axial force for operation but there will be more rotations of the cutter assembly per axial distance traveled. The mechanical advantage, however, would shift to the pencil sharpener and away from the user. In addition to the steepness of the helical slope, the diameter of the helix also influences the efficiency of the pencil sharpener. Wider diameters require more force to operate the sharpener. Smaller diameter helices are preferred provided structural strength is not sacrificed. Also, extreme insertion forces could jam the pencil in the cutter assembly and damage the pencil and possible the cutter assembly as well. Although the rotating direction of the helically grooved rod 36 has been herein described as being counter-clockwise, it should be kept in mind that the construction of this invention should be such that the rod 36 rotates in a direction that would drive the cutter assembly functionally.

The tension of spring 42 should be just enough to return the pencil sharpener to its initial position prior to insertion. A high tension spring, therefore, should not be used.

Various types of cutter assemblies may be used providing that they operate in a rotating movement in order to sharpen a pencil. A simple blade cutter assembly is used in the embodiments herein described. However, within the scope of this invention several such blades or a milling or abrading cutter assembly may be used. In the rotatable contact parts shown in FIGS. 1–5, such as between pencil alignment sleeve 24 and sleeve 22, a washer or ball bearing or the like may be used to reduce friction. This friction reducing device can be placed between ring 25 and the cutter assembly 30. The same can be done between the rotating contacts of helically grooved rod 36 and protective alignment sleeve 34 and also between the rotating contacts of rod 36 and engaging sleeve 38. The same comments apply to the corresponding parts of the other embodiments.

Due to this invention's compact and simple construction, a variety of housing designs can be incorporated. Also, due to the fact that it has no externally protruding wires, cranks or clamps, all that is needed in these housing designs is that they have an opening to insert the pencil. In some designs, telescopic means can be employed, as previously described herein, while in other designs, the pencil can be inserted deeply into the pencil sharpener housing (with a non-movable telescopic housing design) and the inner working parts move with the pencil and sharpen it. For example, a vase can have an opening on its top end for the pencil to be inserted. The pencil is inserted in the opening which is also the opening of the cutter assembly and, as the insertion continues, the pencil with the cutter assembly, sinks into the vase and sharpens the pencil.

It thus will be seen that there is provided a pencil sharpener which achieves the various objects of the invention and which is well adapted to meet the conditions of practical use.

As various possible embodiments might be made of the above invention, and as various changes might be made in the embodiments set forth, it is to be understood that all matter herein described or shown in the accompanying drawings is to be interpreted as illustrative and not in a limiting sense. Thus, it will be understood by those skilled in the art that although preferred and alternate embodiments have been shown and described in accordance with the Patent Statutes, the invention is not limited thereto or thereby.

Having thus described the invention, there is claimed as new and desired to be secured by Letters Patent:

1. A mechanical pencil sharpener actuated by insertion of a pencil thereinto which comprises:

(a) a frame;

(b) a cutter assembly having a longitudinal axis, said cutter assembly being rotatably and slidably mounted in said frame, such that a pencil to be sharpened may be inserted into the cutter assembly and forced against a portion thereof to cause sliding movement in the direction of movement of the pencil, from an initial position to a displaced position;

(c) a rod for rotating said cutter assembly to sharpen the pencil, said rod having an elongated longitudinal axis, said rod depending from said cutter assembly, being coaxially aligned therewith and being kinematically unitary with said cutter assembly, said rod including means disposed longitudinally of its length for effecting such rotation of the cutter assembly;

(d) a sleeve fixably mounted within said frame and including means meshing with the means extending longitudinally of said rod for translating said sliding movement of said rod and said cutter assembly into simultaneous rotational movement of said rod and said cutter assembly, said sleeve being axially coincident with said rod and concentrically disposed thereto;

(e) a spring fixedly mounted between said cutter assembly and said frame, said spring being so arranged that said sliding movement of said cutter assembly pushes against said spring to compress it when a pencil is inserted and when the pencil is withdrawn, said spring returns to its initial position which, in turn, returns said cutter assembly to its initial position; and (f) conversion means cooperating with said rod for rotating said cutter assembly upon insertion of the pencil and longitudinal movement of said rod, said conversion means including a coupling which renders the drive train ineffective upon withdrawal of the pencil and return of the cutter assembly to its initial position.

2. A mechanical pencil sharpener as defined in claim 1 wherein the coupling constitutes:

two claw-type halves, a first half being slidably and rotatably mounted concentric with and external to said rod, the second half being stationary within said frame, the claws of said first half being connectable to the claws of said second half in one sense of rotation only, and when connected the coupling halves becoming kinematically unitary, said second half having a central passageway therethrough, sufficently large to permit passage of the cross-sectional area of said rod therethrough, said first half of said coupling being kinematically unitary with said engaging sleeve, the two halves being so structured that the insertion of said pencil in said cutter assembly and movement of the pencil into the sharpener causes the halves to connect and hold the engaging sleeve slidably and rotatably stationary relative to said sliding movement of said rod in the direction of movement of said pencil.

3. A mechanical pencil sharpener as defined in claim 1 further including a first coupling means comprised of two claw-type halves, a first half of said first coupling means including a guide pin extending through a second half of said first coupling means and aligning said first and second halves of said first coupling means, said first half of said first coupling means being slidable and fixedly mounted to said cutter assembly and rotatable therewith, the second half of said first coupling means being mounted to be slidable and rotatable within said sleeve and rotatable with respect to said guide pin, the claws of said first half of said first coupling means being connectable to the claws of said second half of said first coupling means in one sense of rotation only, and when connected the coupling halves becoming kinematically unitary therewith, whereby the insertion of said pencil in said cutter assembly causes the halves of said first coupling means to connect and the sleeve rotates relative to the rod and transmits the rotational motion of said engaging sleeve to said cutter assembly, the coupling halves becoming disconnected upon withdrawal of the pencil so that upon such withdrawal the cutter assembly does not rotate.

4. A mechanical pencil sharpener actuated by insertion of a pencil thereinto which comprises:

(a) a frame;

(b) a cutter assembly having a longitudinal axis, said cutter assembly being rotatably and slidably mounted in said frame, such that a pencil to be sharpened may be inserted into said cutter assembly and forced against a portion thereof to cause sliding movement of said cutter assembly in the direction of movement of the pencil, from an initial position to a displaced position;

(c) gear means for rotating said cutter assembly to sharpen the pencil, a rod connecting said cutter assembly to said gear means, said rod depending from said cutter assembly, being coaxially aligned therewith and being kinematically unitary with said cutter assembly and said gear means, said gear means and rod translating slidable axial movement of said cutter assembly into rotational movement thereof;

(d) a spring having a portion bearing against said frame, said spring being so arranged that sliding movement of said cutter assembly pushes against said spring to compress it when the pencil is inserted and when the pencil is withdrawn, and being further so arranged that said spring returns said cutter assembly and said gear means to their initial positions; and (e) means for rendering said gear means ineffective upon withdrawal of the pencil so that upon such withdrawal said cutter assembly does not rotate.

5. A mechanical pencil sharpener as defined in claim 4 wherein said gear means comprises a rack and pinion gear.

6. A mechanical pencil sharpener as defined in claim 4 wherein said gear means comprises a rack and pinion gear and further includes a cable kinematically connecting said pinion gear to said gear means.

7. A mechanical pencil sharpener as defined in claim 4 further comprising a coupling means comprised of two claw-type halves, a first half of said coupling means being slidably and rotatably mounted within said frame and coaxial with and depending from said cutter assembly, the second half of said coupling means being slidably and rotationally mounted within said frame and coaxial with said gear means, said first and second coupling means being axially aligned via said rod and concentric therewith and external thereto, the claws of said first half of said coupling being connectable to the claws of said second half of said coupling in one sense of rotation only and when connected, the coupling halves become kinematically unitary, said second half of said coupling and said first half of said coupling each having a central passageway therethrough sufficiently large to permit passage of the cross-sectional area of said rod therethrough, said first half of said coupling being kinematically unitary with said cutter assembly and said second half of said second coupling being connected to said gear means to become kinematically unitary therewith, the insertion of said pencil in said cutter assembly causing the halves of said coupling to connect and rotate said cutter assembly as said gear means is rotated in response to slidable movement of said cutter assembly in the direction of movement of said pencil.

8. A mechanical pencil sharpener actuated by pushing a pencil therein, said sharpener comprising:

(a) a cutter assembly;

(b) means mounting said cutter assembly for rotation and for longitudinal movement in a direction parallel to the direction of the pencil being pushed into the sharpener from an initial position to a displaced position;

(c) a stationary member;

(d) a spring positioned between said cutter assembly and said stationary rod to store energy upon movement of the cutter assembly away from its initial position and to restore said assembly to its initial position upon withdrawal of the pencil;

(e) means to rotate said cutter assembly upon pushing of the pencil into the sharpener; and (f) means to render said rotating means inoperable during restoration of the cutter assembly to its initial position by the spring.

* * * * *